US010546547B2

(12) United States Patent
Li

(10) Patent No.: US 10,546,547 B2
(45) Date of Patent: Jan. 28, 2020

(54) DEVICE FOR ADJUSTING COMMON ELECTRODE VOLTAGE BY DETECTING COMMON ELECTRODE VOLTAGE TO CHANGE POLARITY INVERSION SIGNAL AND METHOD THEREOF, DRIVING CIRCUIT AND DISPLAY DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventor: Kun Li, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/679,992

(22) Filed: Aug. 17, 2017

(65) Prior Publication Data

US 2018/0082650 A1 Mar. 22, 2018

(30) Foreign Application Priority Data

Sep. 22, 2016 (CN) ..... 2016 1 0843785

(51) Int. Cl.
*G09G 3/36* (2006.01)

(52) U.S. Cl.
CPC ..... *G09G 3/3614* (2013.01); *G09G 3/3655* (2013.01); *G09G 2310/08* (2013.01); *G09G 2330/02* (2013.01); *G09G 2330/08* (2013.01)

(58) Field of Classification Search
CPC ..... G09G 3/3614–3644; G09G 3/3655; G09G 2300/0876; G09G 2310/0254–0256; G09G 2310/068
See application file for complete search history.

(56) References Cited

U.S. PATENT DOCUMENTS

2009/0251451 A1* 10/2009 Cha ..... G09G 3/3614 345/211
2009/0289928 A1 11/2009 Shi
(Continued)

FOREIGN PATENT DOCUMENTS

CN 101587685 A 11/2009
CN 104680997 A 6/2015
(Continued)

OTHER PUBLICATIONS

First Office Action for Chinese Application No. 201610843785.8, dated Jun. 4, 2018, 11 Pages.
CN104680997A, English Abstract and Machine Translation.

*Primary Examiner* — Sanghyuk Park
(74) *Attorney, Agent, or Firm* — Brooks Kushman P.C.

(57) ABSTRACT

The present disclosure provides a device for adjusting a common electrode voltage and a method thereof, a driving circuit and a display device. The device for adjusting the common electrode voltage includes: a common-electrode-voltage monitor, configured to detect a common electrode voltage on the common electrode line in real time, judge whether the common electrode voltage is within a first voltage range, and output an adjustment control signal in the case that the common electrode voltage is beyond the first voltage range in each of N data-source row-latch periods within one frame period, wherein N is a positive integer; and a polarity inversion controller, connected with the common-electrode-voltage monitor and configured to change a polarity inversion signal upon receiving the adjustment control
(Continued)

signal, so as to adjust the common electrode voltage on the common electrode line.

11 Claims, 5 Drawing Sheets

(56) References Cited

U.S. PATENT DOCUMENTS

| | | | | |
|---|---|---|---|---|
| 2014/0132580 | A1* | 5/2014 | Hu | G09G 3/3614 345/209 |
| 2016/0140920 | A1* | 5/2016 | Lee | G09G 3/3614 345/209 |
| 2016/0171943 | A1* | 6/2016 | Baek | G09G 3/3614 345/209 |
| 2016/0300544 | A1 | 10/2016 | Ding et al. | |

FOREIGN PATENT DOCUMENTS

| | | | |
|---|---|---|---|
| CN | 104732943 | A | 6/2015 |
| CN | 105096784 | A | 11/2015 |
| JP | 2011209453 | A | 10/2011 |

* cited by examiner

DEVICE FOR ADJUSTING COMMON ELECTRODE VOLTAGE BY DETECTING COMMON ELECTRODE VOLTAGE TO CHANGE POLARITY INVERSION SIGNAL AND METHOD THEREOF, DRIVING CIRCUIT AND DISPLAY DEVICE

CROSS-REFERENCE TO RELATED APPLICATION

The present application claims priority to Chinese Patent Application No. 201610843785.8 filed on Sep. 22, 2016, which is incorporated herein by reference in its entirety.

TECHNICAL FIELD

The present disclosure relates to the field of control technology, in particular to a device for adjusting a common electrode voltage and a method thereof, a driving circuit and a display device.

BACKGROUND

With developments of liquid crystal display technology, there is an increasingly high demand for a display effect of a liquid crystal display panel. A liquid crystal capacitance varying with a grayscale voltage leads to different symmetric central potentials of positive and negative potentials in different patterns, which results in serious fluctuation of a common electrode voltage (Vcom) of each point in the display panel within one frame period or between adjacent frames, thereby causing a display defect such as greenish, crosstalk, flicker, or the like.

In a device for adjusting the common electrode voltage and method thereof of a related art, the display effect of the panel is adjusted by automatically determining a compensation multiple of the common electrode voltage or by compensating a reference voltage of deflection of a liquid crystal molecule. However, such an adjusting scheme has low accuracy, and it is difficult to control a timing of compensation, so that the display defect cannot be effectively eliminated.

SUMMARY

A main object of the present disclosure is to provide a device for adjusting a common electrode voltage and a method thereof, a driving circuit and a display device.

In order to achieve the above object, the present disclosure provides a device for adjusting a common electrode voltage, the device being connected to a common electrode line on a display panel, including: a common-electrode-voltage monitor, configured to detect a common electrode voltage on the common electrode line in real time, judge whether the common electrode voltage is within a first voltage range, and output an adjustment control signal in the case that the common electrode voltage is beyond the first voltage range in each of N data-source row-latch periods within one frame period, wherein N is a positive integer; and a polarity inversion controller, connected with the common-electrode-voltage monitor, and configured to change a polarity inversion signal upon receiving the adjustment control signal, so as to adjust the common electrode voltage on the common electrode line.

Optionally, the polarity inversion controller is further configured to change the polarity inversion signal in a current frame or in a next adjacent frame upon receiving the adjustment control signal.

Optionally, the common-electrode-voltage monitor includes: a common-electrode-voltage detector, configured to detect the common electrode voltage on the common electrode line in real time; a comparator, connected with the common-electrode-voltage detector, and configured to determine whether the common electrode voltage is within the first voltage range, and output a fluctuation indication signal in the case that the common electrode voltage is beyond the first voltage range; and a counter, connected with the comparator and the polarity inversion controller, and configure to start to count at a start of each frame, read a signal output by the comparator once in each data-source row-latch period of each frame period, increment a count value by 1 in the case that the comparator outputs the fluctuation indictor signal, and output the adjustment control signal to the polarity inversion controller in the case that the count value is incremented by N within one frame period.

Optionally, the count value is reset to zero at the beginning of each frame.

Optionally, the comparator is further configured to compare the common electrode voltage with an upper threshold voltage, and output the fluctuation indication signal in the case that the common electrode voltage is greater than the upper threshold voltage; or compare the common electrode voltage with a lower threshold voltage, and output the fluctuation indication signal in the case that the common electrode voltage is less than the lower threshold voltage; wherein the upper threshold voltage is greater than the lower threshold voltage.

Optionally, the comparator includes: a dual-threshold voltage comparator, an input terminal of which is connected with an output terminal of the common-electrode-voltage detector and an output terminal of which is connected with the counter, the dual-threshold voltage comparator being configured to output the fluctuation indication signal in the case that the common electrode voltage is greater than the upper threshold voltage or the common electrode voltage is less than the lower threshold voltage.

Optionally, the polarity inversion controller is arranged in a timing controller and comprises a control terminal and a polarity inversion signal output terminal; the counter comprises a counter; the counter comprises a trigger terminal, a clock signal input terminal, a reset terminal and an enable signal output terminal; the trigger terminal of the counter is connected with the output terminal of the dual-threshold voltage comparator; the reset terminal of the counter is connected with an initial signal output terminal of the timing controller; the clock signal input terminal of the counter is connected with a data-source row-latch signal output terminal of the timing controller; the enable signal output terminal of the counter is connected with the control terminal of the polarity inversion controller; the counter is configured to restart to count from 0 in the case that an initial signal received by the reset terminal of the counter has a high level, wherein the count value of the counter is incremented by 1 in the case that the data-source row-latch signal received by the clock signal input terminal of the counter is latched at a falling edge and the signal that is output by the output terminal of the dual-threshold voltage comparator and read by the trigger terminal of the counter is the fluctuation indication signal; the enable signal output terminal of the counter is configured to output the adjustment control signal to the control terminal of the polarity inversion controller in the case that the count value of the counter reaches N; and the polarity inversion controller configured to change the polarity inversion signal upon receiving the adjustment control signal by the control terminal of the polarity inversion controller, and output a changed polarity inversion signal through the polarity inversion signal output terminal.

The present disclosure further provides a method for adjusting a common electrode voltage, including: a monitoring step of detecting the common electrode voltage on a common electrode line in real time on a display panel and judging whether the common electrode voltage is within a first voltage range; an adjustment-control-signal outputting step of outputting an adjustment control signal in the case that the common electrode voltage is beyond the first voltage range in each of N data-source row-latch periods within one frame period, wherein N is a positive integer; and a polarity inversion controlling step of changing a polarity inversion signal under the control of the adjustment control signal so as to adjust the common electrode voltage on the common electrode line.

Optionally, the polarity inversion controlling step further includes changing the polarity inversion signal in a current frame or a next adjacent frame, and returning to the monitoring step at the beginning of the next adjacent frame.

Optionally, the adjustment-control-signal outputting step further includes: outputting a fluctuation indication signal in the case that the common electrode voltage is beyond the first voltage range; starting to count at the beginning of each frame; and reading a signal output by the comparator once in each data-source row-latch period of each frame period, incrementing a count value by 1 in case of outputting the fluctuation indictor signal, and outputting the adjustment control signal in the case that the count value is incremented by N within one frame period.

Optionally, the step of outputting a fluctuation indication signal in the case that the common electrode voltage is beyond the first voltage range includes: outputting the fluctuation indication signal in the case that the common electrode voltage is greater than an upper threshold voltage; or outputting the fluctuation indication signal in the case that the common electrode voltage is less than a lower threshold voltage.

Optionally, the count value is reset to zero at the beginning of each frame.

The present disclosure further provides a driving circuit of a display panel, including any above-mentioned device for adjusting the common electrode voltage.

Optionally, the driving circuit further includes a timing controller, wherein the common-electrode-voltage monitor comprises a common-electrode-voltage detector, a comparator and a counter; the polarity inversion controller is arranged in the timing controller and comprises a control terminal and a polarity inversion signal output terminal; the counter is connected with an initial signal output terminal of the timing controller and a data-source row-latch signal output terminal of the timing controller; and an adjustment-control-signal output terminal of the counter is connected with the control terminal.

The present disclosure further provides a display device, including any above-mentioned driving circuit.

DETAILED DESCRIPTION

The technical solutions in the embodiments of the present disclosure will be clearly and completely described hereinafter with reference to the accompanying drawings. Apparently, these embodiments described herein are merely parts of the embodiments of the present disclosure rather than all the embodiments. Based on the embodiments of the present disclosure, any other embodiments obtained by a person skilled in the art without any creative effort shall fall within the protection scope of the present disclosure.

Figure 1:
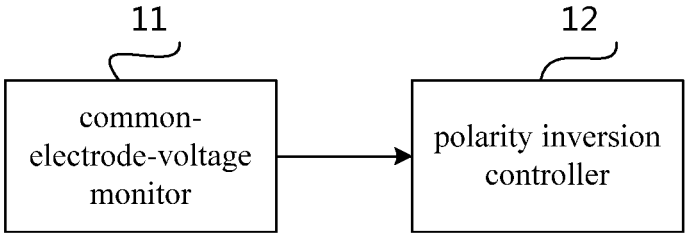
FIG. 1 is a structural diagram of a device for adjusting a common electrode voltage according to some embodiments of the present disclosure.

As shown in FIG. 1, the device for adjusting the common electrode voltage according to some embodiments of the present disclosure, connected to the common electrode line (not shown in FIG. 1) on a display panel, includes a common-electrode-voltage monitor 11 and a polarity inversion controller 12.

The common-electrode-voltage monitor 11 is configured to detect a common electrode voltage Vcom on the common electrode line, judge whether the common electrode voltage Vcom is within a first voltage range, and output an adjustment control signal in the case that the common electrode voltage Vcom is beyond the first voltage range in each of N data-source row-latch periods within one frame period, wherein N is a positive integer. It should be noted that the first voltage range may be set according to an actual application situation.

The polarity inversion controller 12, connected with the common-electrode-voltage monitor 11, is configured to change a polarity inversion signal upon receiving the adjustment control signal, so as to adjust the common electrode voltage on the common electrode line.

According to the device for adjusting the common electrode voltage of the embodiment of the present disclosure, the common electrode voltage Vcom on the common electrode line in real time is detected by the common-electrode-voltage monitor 11, and the polarity inversion signal (also referred to as a "POL signal") is changed by the polarity inversion controller when it is detected that Vcom seriously fluctuates (that is, Vcom is beyond the predetermined range in each of N data-source row-latch periods (also referred to as "TP period") within one frame period), so that Vcom is kept stable, so as to prevent or correct various display defects caused by serious fluctuation of Vcom.

The device for adjusting the common electrode voltage according to the embodiment of the present disclosure can automatically change a polarity inversion manner of a POL signal by monitoring the serious fluctuation of Vcom, so as to prevent or correct the display defect.

In some embodiments, a TP signal is a data-source row-latch signal input by the timing controller to a source driver. When a certain row of thin film transistors (TFTs) is turned on, the source driver converts an input digital signal into an analog signal and then outputs the analog signal to the source of TFT, latches data at a rising edge of the TP signal, and outputs data at a falling edge of the TP signal. The POL signal may be a polarity inversion signal for controlling a pixel voltage polarity. The device for adjusting the common electrode voltage according to the embodiment of the present disclosure keeps Vcom stable through changing the POL signal by the polarity inversion controller to change a liquid crystal inversion manner in the display panel, so as to prevent or correct the display defect.

The device for adjusting the common electrode voltage according to the embodiment of the present invention has a relatively strong universality, and can effectively adjust Vcom to solve a problem of poor display, thereby improving display quality.

Preferably, the polarity inversion controller is further configured to change the polarity inversion signal in a current frame or a next adjacent frame upon receiving the adjustment control signal.

Further, in the case that the polarity inversion controller receives the adjustment control signal, the polarity inversion signal is changed in the current frame or the next adjacent frame, and then if it is determined by the common-electrode-voltage monitor that the common electrode voltage is beyond the first voltage range in each of the N data-source row-latch periods in the next adjacent frame, the adjustment control signal is output again.

Figure 2:
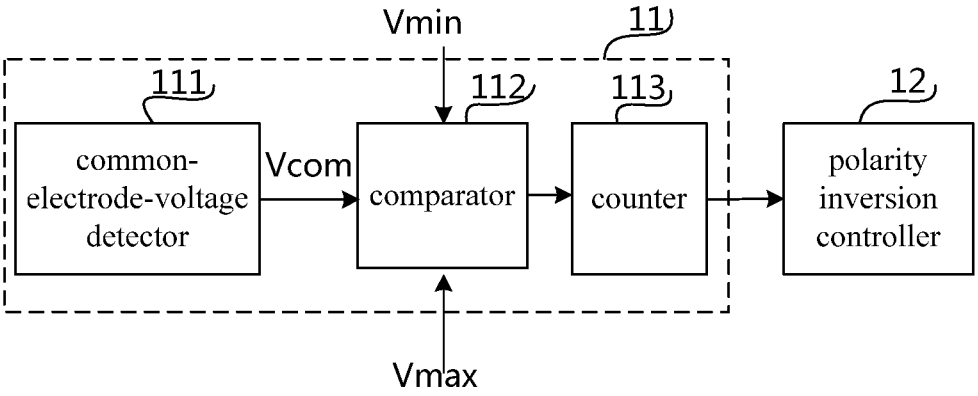
FIG. 2 is a structural diagram of a device for adjusting a common electrode voltage according to some embodiments of the present disclosure.

Specifically, as shown in FIG. 2, the common-electrode-voltage monitor 11 includes a common-electrode-voltage detector 111, a comparator 112 and a counter 113.

The common-electrode-voltage detector 111 is configured to detect the common electrode voltage on the common electrode line in real time.

The comparator 112, connected with the common-electrode-voltage detector 111, is configured to compare the common electrode voltage Vcom with the upper threshold voltage Vmax or compare the common electrode voltage Vcom with the lower threshold voltage Vmin, and output a fluctuation indication signal in the case that the common electrode voltage Vcom is larger than the upper threshold voltage Vmax or the common electrode voltage Vcom is less than the lower threshold voltage Vmin. It should be noted that the upper threshold voltage and the lower threshold voltage may be set according to an actual application situation.

The counter 113, connected with the comparator 112 and the polarity inversion controller 12, is configured to start to count at a start of each frame, reading a signal output by the comparator 112 once in each data-source row-latch period of each frame period, increment a count value by 1 in the case that the comparator outputs the fluctuation indictor signal, and output the adjustment control signal to the polarity inversion controller 12 in the case that the count value is incremented by N within one frame period.

Optionally, the count value is reset to zero at the beginning of each frame. In this way, when the count value within one frame period reaches N, the adjustment control signal is output to the polarity inversion controller 12.

Optionally, the comparator 112 is further configured to compare the common electrode voltage with the predetermined upper threshold volt, and output the fluctuation indication signal in the case that the common electrode voltage is greater than the upper threshold voltage. Or, the comparator 112 is further configured to compare the common electrode voltage with the lower threshold voltage, and output the fluctuation indication signal in the case that the common electrode voltage is less than the lower threshold voltage. The upper threshold voltage is larger than the lower threshold voltage.

In the embodiment as shown in FIG. 2 of the present disclosure, the common-electrode-voltage monitor 11 includes the common-electrode-voltage detector 111, the comparator 112 and the counter 113. Vcom is kept stable through detecting the common electrode voltage Vcom on the common electrode line in real time by the common-electrode-voltage detector 111, resetting the count value to zero by the counter 113 at the beginning of each frame, and then comparing Vcom with Vmax or comparing Vcom with Vmin by the comparator 112 in each TP period of this frame, and outputting the fluctuation indication signal by the comparator 112 to the counter 113 in the case that Vcom is larger than Vmax or Vcom is less than Vmin, and incrementing the count value by 1 and outputting the adjustment control signal by the counter 113 to the polarity inversion controller 12 in the case that the count value reaches N (N is a positive integer). That is, in the case that the common electrode voltage is beyond the predetermined range (i.e., the common electrode voltage seriously fluctuates) in each of the N TP periods within one frame period.

Figure 3:
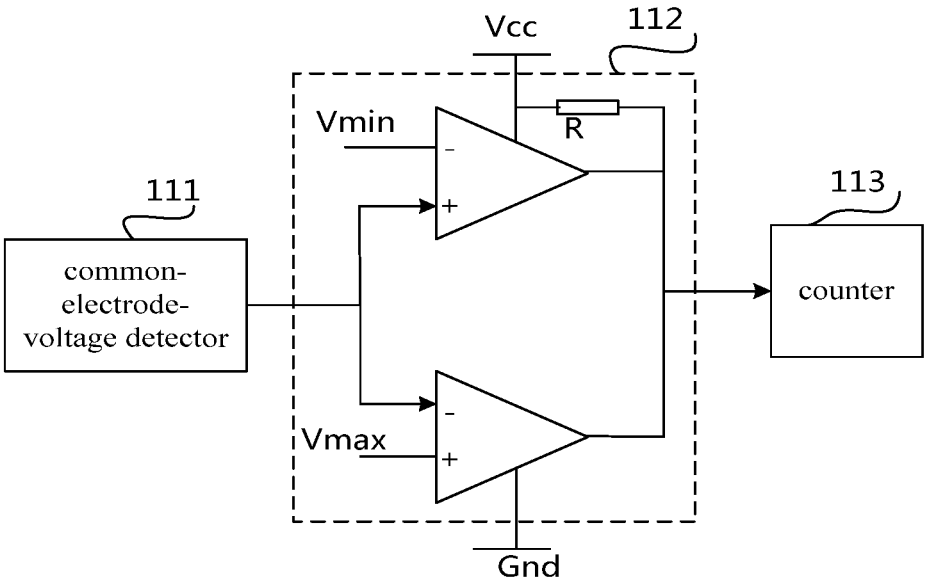
FIG. 3 is a structural diagram of a device for adjusting a common electrode voltage according to some embodiments of the present disclosure.

As shown in FIG. 3, the comparator 112 includes a dual-threshold voltage comparator Cmp, an input terminal of which is connected with an output terminal of the common-electrode-voltage detector 111 and an output terminal of which is connected with the counter 113, the dual-threshold voltage comparator being configured to output the fluctuation indication signal in the case that the common electrode voltage Vcom is greater than the upper threshold voltage Vmax or the common electrode voltage is less than the lower threshold voltage Vmin.

In FIG. 3, R is a comparison resistance, Vcc is a high voltage and Gnd is a ground terminal.

Figure 4:
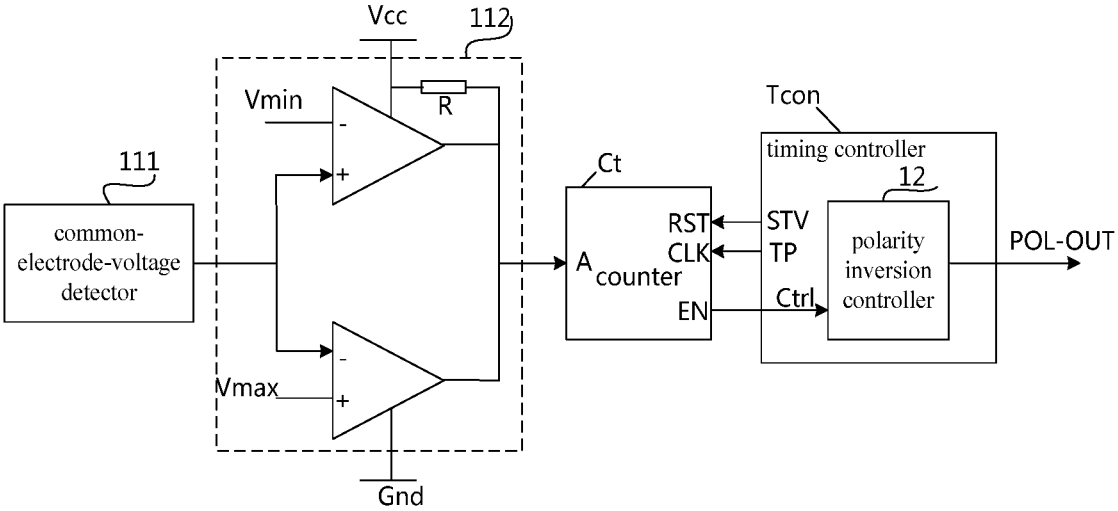
FIG. 4 is a structural diagram of a device for adjusting a common electrode voltage according to some embodiments of the present disclosure.

As shown in FIG. 4, the polarity inversion controller 12 is arranged in a timing controller Tcon and includes a control terminal Ctrl and a polarity inversion signal output terminal POL-OUT.

The counter includes the counter Ct which includes a trigger terminal A, a clock signal input terminal CLK, a reset terminal RST and an enable signal output terminal EN. The trigger terminal A of the counter Ct is connected with the output terminal of the dual-threshold voltage comparator Cmp; the reset terminal RST of the counter Ct is connected with an initial signal output terminal STV of the timing controller Tcon; the clock signal input terminal CLK of the counter Ct is connected with a data-source row-latch signal output terminal TP of the timing controller Tcon; and the enable signal output terminal EN of the counter Ct is connected with the control terminal Ctrl of the polarity inversion controller 12.

When the initial signal received by the reset terminal RST of the counter Ct has a high level, the counter restart to count from 0; when the data-source row-latch signal input from the clock signal input terminal CLK of the counter Ct is latched at a falling edge, when the trigger terminal A of the counter Ct reads the signal output by the output terminal of the dual-threshold voltage comparator Cmp, and the trigger terminal A reads the fluctuation indication signal, the count value of the counter Ct is incremented by 1.

when the count value of the counter Ct within one frame period reaches N, the enable signal output terminal EN of the counter Ct outputs the adjustment control signal to the control terminal Ctrl of the polarity inversion controller 12; and when the control terminal Ctrl of the polarity inversion controller 12 receives the adjustment control signal, the polarity inversion controller 12 is configured to change the polarity inversion signal, and output a changed polarity inversion signal through the polarity inversion signal output terminal POL-OUT.

In the embodiment as shown in FIG. 4 of the present disclosure, in operation, the common voltage Vcom at a Panel (display panel) terminal is input to the dual-threshold voltage comparator Cmp. When Vmin<Vcom<Vmax, the dual-threshold voltage comparator Cmp outputs a high level; and when Vcom<Vmin or Vcom>Vmax, the dual-threshold voltage comparator Cmp outputs a low level. Therefore, a normal fluctuation range of the signal of Vcom can be set by setting upper and lower fluctuation limits of the Vcom signal, that is, by setting the values of Vmax and Vmin. The value of Vcom exceeding this range may be detected by the conversion of the level output by the dual-threshold voltage comparator Cmp.

The counter Ct receives the signal output by the dual-threshold voltage comparator, and the TP signal and the STV signal from Tcon. The TP signal is input to the CLK of the counter Ct. During each TP period, the counter Ct reads the signal output by the dual-threshold voltage comparator. When a low level is read, the count value of the counter is incremented by 1. When the count value of the counter reaches N, the enable signal EN of the counter Ct outputs the adjustment control signal to the polarity inversion controller 12 arranged in Tcon.

In a practical operation, N may be set as any positive integer as appropriate. The less N is, the more frequent the inversion manner is switched.

When the polarity inversion controller 12 arranged in Tcon receives the adjustment control signal output by EN, the POL signal is changed in the current frame or the next frame. When the adjustment control signal is still received in the next frame, the POL signal will continue to be changed, until Vcom does not fluctuate.

It should be noted that the liquid crystal inversion manner is changed by changing the POL signal, and the change in the liquid crystal inversion manner can improve the pulling of Vcom.

The polarity inversion includes column inversion, dot inversion, 2 dot inversion, 1+2 dot inversion, Z dot inversion, 1 line dot inversion, (1+2) line dot inversion, or the like. In a practical operation, in a different pattern and a different display mode (for example, a normally white mode, a normally black mode, or the like), it is not certain whether the Vcom fluctuates or not in various polarity inversions. In a certain display mode and a certain pattern, how to change the polarity inversion manner to keep Vcom stable is known to a person skilled in the art. Therefore, an embodiment is given below by taking the change in Vcom in the case of the conversion between two polarity inversion manners in one pattern and display mode as an example.

Figure 5:
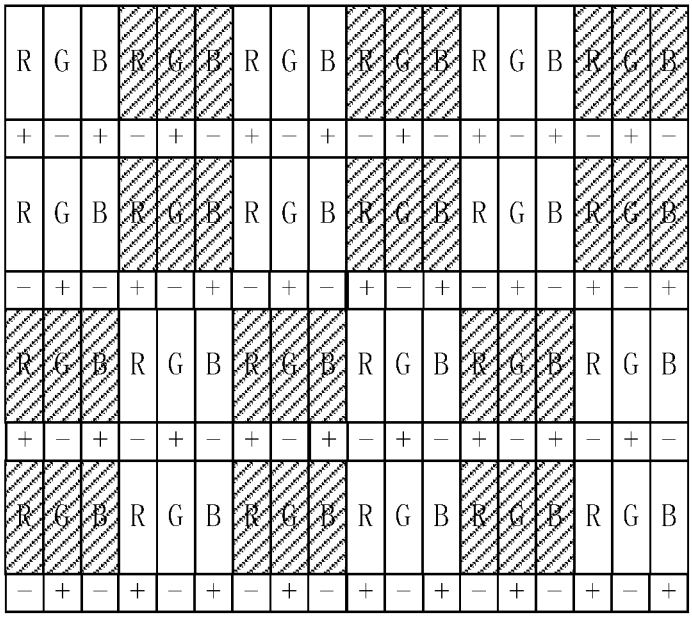
FIG. 5 is a schematic diagram of a specific pattern with 1 line dot inversion.
Figure 6:
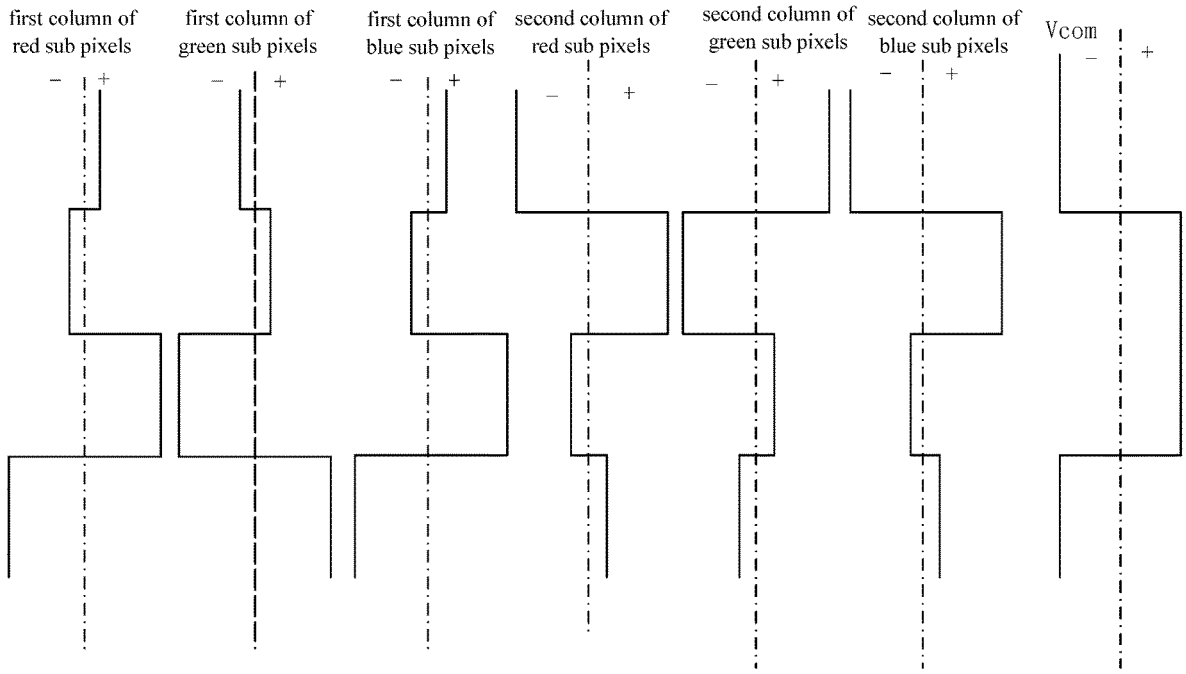
FIG. 6 is a schematic diagram of each voltage in the 1 line dot inversion of the pattern shown in FIG. 5.

For example, the pattern as shown in FIG. 5 is the same as that as shown in FIG. 6, and the patterns shown in FIG. 5 and FIG. 6 are in the normally white mode. Due to the normally white mode, a voltage value of the data voltage corresponding to a sub pixel is relatively large in case of showing black (in FIGS. 5 and 6, a red sub pixel R, a green sub pixel G, and a blue sub pixel B with shades are sub pixels for displaying black) as needed.

The pattern shown in FIG. 5 adopts the 1 line dot inversion, and the voltage values of the first column of pixels, the voltage values of the second column of pixels and Vcom are as shown in FIG. 6. It is known from FIG. 6 that in the 1 line dot inversion, the waveform of Vcom of the first row of pixel points is pulled to left, the waveform of Vcom of the second row of pixel points and the waveform of Vcom of the third row of pixel point are pulled to right, and the waveform of Vcom of the fourth row of pixel points is pulled to the left, so that a greenish phenomenon tends to occur.

Figure 7:
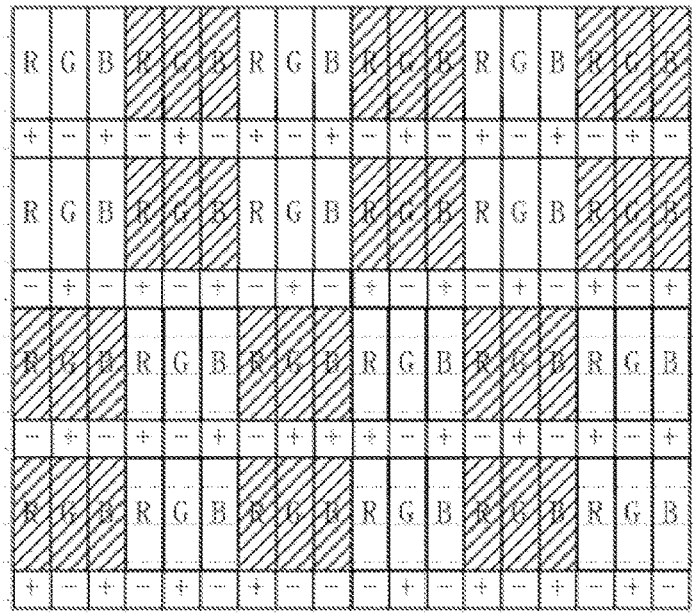
FIG. 7 is a schematic diagram of a specific pattern with (1+2) line dot inversion.
Figure 8:
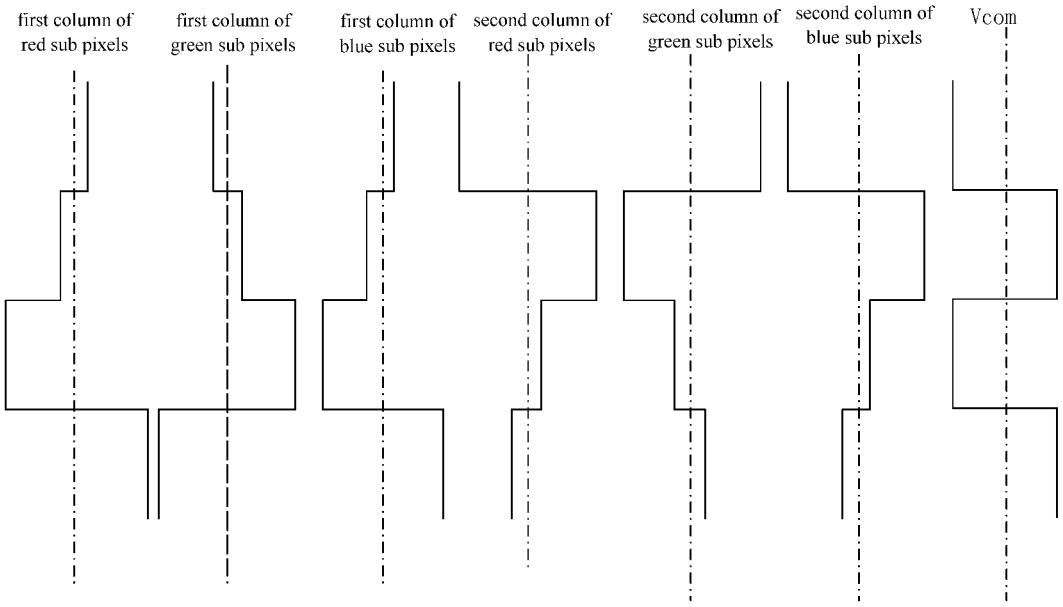
FIG. 8 is a schematic diagram of each voltage in the (1+2) line dot inversion of the pattern shown in FIG. 7.

The pattern shown in FIG. 7 adopts the (1+2) line dot inversion, and the voltage values of the first column of pixels and the second column of pixels, as well as Vcom, are as shown in FIG. 8. As shown in FIG. 8, in the (1+2) line dot inversion, compared with the 1 line dot inversion, the waveform of Vcom of the third row of pixel points is pulled to the left, resulting in a more uniform distribution of Vcom of each pixel point. The greenish phenomenon seldom occurs in the pattern as shown in FIG. 7.

Similarly, when the display defect such as crosstalk and flicker occurs in the pattern, Vcom may not fluctuate any more by changing the POL signal.

Figure 9:
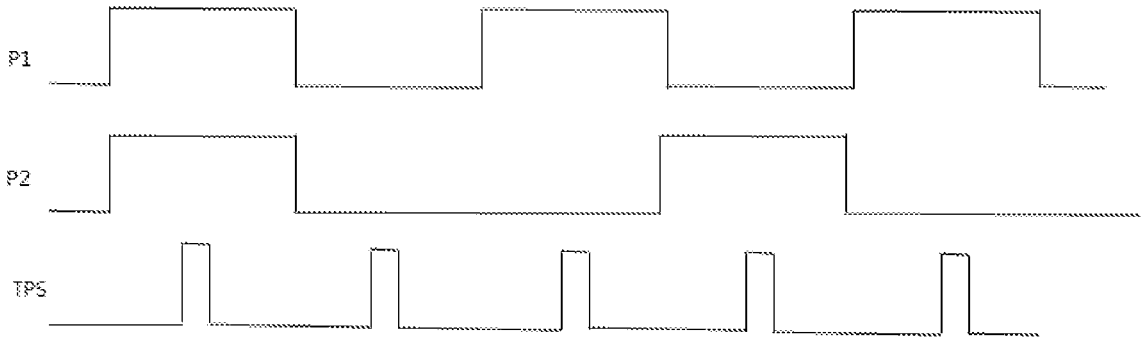
FIG. 9 is a schematic diagram of a POL signal and a TP signal in 1 line dot inversion and (1+2) line dot inversion.

FIG. 9 is a timing chart of the POL signal P1 corresponding to the 1 line dot inversion, the POL signal P2 corresponding to the (1+2) line dot inversion and the TP signal TPS.

Figure 10:
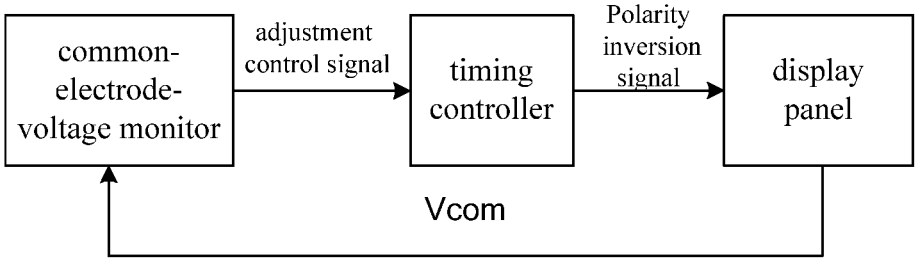
FIG. 10 is a schematic diagram showing an overall structure of the device for adjusting the common electrode voltage as shown in FIG. 4 of the present disclosure.
Figure 11:
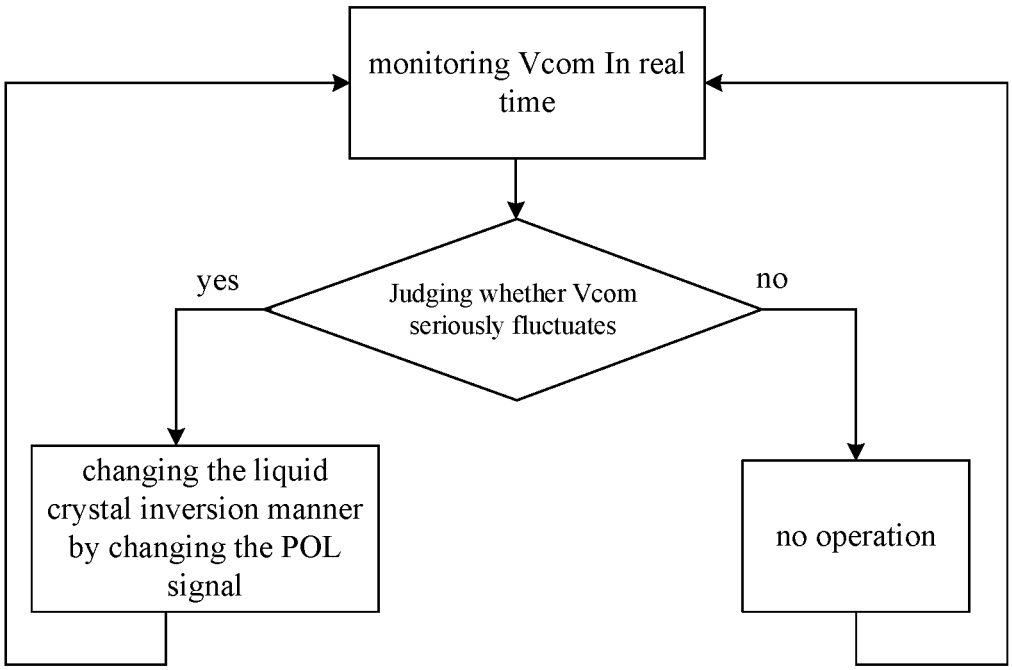
FIG. 11 is a logical flow diagram of the device for adjusting the common electrode voltage as shown in FIG. 4 of the present disclosure.

The schematic diagram of the overall structure of the device for adjusting the common electrode voltage shown in FIG. 4 of the present disclosure is shown in FIG. 10, and the logical flow is shown in FIG. 11. As shown in FIGS. 10 and 11, the implementation scheme may be a closed-loop feedback control, which can effectively ensure the implementation effect.

It should be noted that the above is exemplary only, and the implementation manner of the common-electrode-voltage monitor and the polarity inversion controller in the embodiment of the present disclosure is not limited. For example, they can be implemented by hardware, firmware, software or any combination thereof.

The device for adjusting the common electrode voltage according to the embodiment of the present disclosure is simple and easy to implement, has high real-time property and has a closed-loop feedback and high accuracy.

Figure 12:
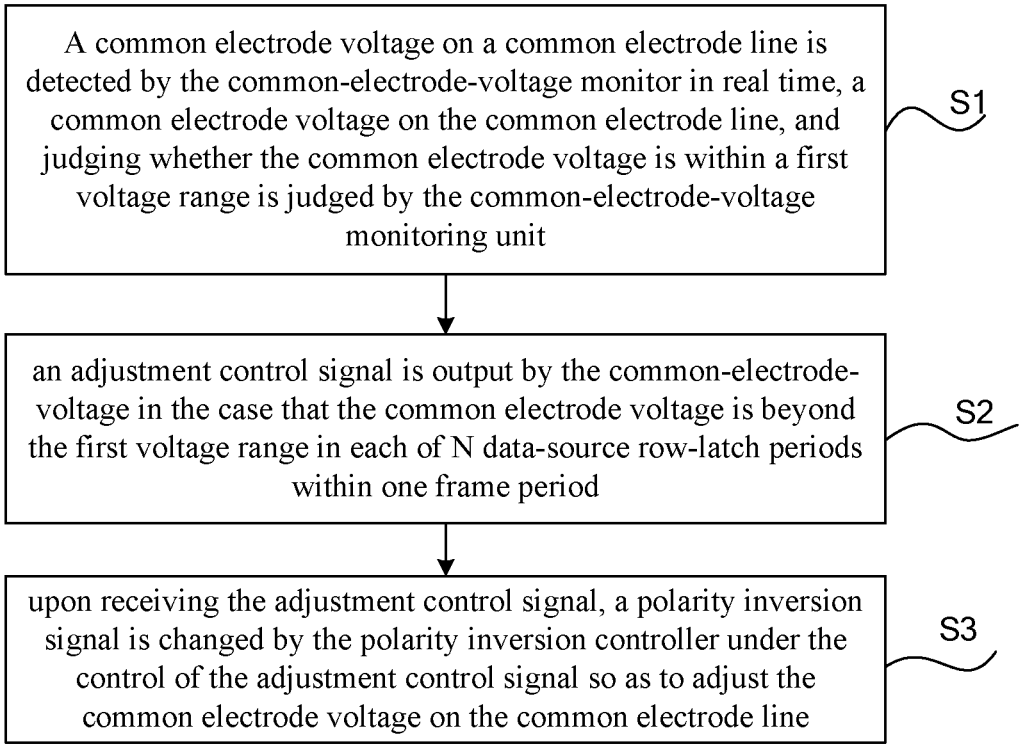
FIG. 12 is a flow chart of the method for adjusting the common electrode voltage according to some embodiments of the present disclosure.

As shown in FIG. 12, the method for adjusting the common electrode voltage according to the embodiment of the present disclosure includes following steps.

In monitoring step S1, a common electrode voltage on a common electrode line is detected in real time, and whether the common electrode voltage is within a first voltage range is judged by the common-electrode-voltage monitor.

In adjustment-control-signal outputting step S2, an adjustment control signal is output by the common-electrode-voltage in the case that the common electrode voltage is beyond the first voltage range in each of N data-source row-latch periods within one frame period, wherein N is a positive integer.

In polarity inversion controlling step S3, upon receiving the adjustment control signal, a polarity inversion signal is changed by the polarity inversion controller under the control of the adjustment control signal so as to adjust the common electrode voltage on the common electrode line Specifically, the polarity inversion controlling step specifically includes changing the polarity inversion signal in a current frame or a next adjacent frame when the polarity inversion controller receives the adjustment control signal, and returning to the monitoring step at the beginning of the next adjacent frame.

The driving circuit of a display panel according to an embodiment of the present disclosure includes the above device for adjusting the common electrode voltage.

Specifically, the driving circuit includes a timing controller; the device for adjusting the common electrode voltage includes a common-electrode-voltage monitor and a polarity inversion controller. The common-electrode-voltage monitor includes a common-electrode-voltage detector, a comparator and a counter. The polarity inversion controller is arranged in the timing controller and includes a control terminal and a polarity inversion signal output terminal. The counter is connected with an initial signal output terminal of the timing controller and a data-source row-latch signal output terminal of the timing controller. The adjustment-control-signal output terminal of the counter is connected with the control terminal.

The above method can be implemented by the device for adjusting the common electrode voltage according to the embodiment of the present disclosure, which is not repeated herein.

The display device according to some embodiment of the present disclosure may further include the above driving circuit.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A device for adjusting a common electrode voltage, the device being connectable to a common electrode line on a display panel, comprising:

a common-electrode-voltage monitor configured to detect a common electrode voltage on the common electrode line in real time, judge whether the common electrode voltage is within a first voltage range, and output an adjustment control signal in the case that the common electrode voltage is beyond the first voltage range in each of N data-source row-latch periods within one frame period, wherein N is a positive integer; and a polarity inversion controller connected with the common-electrode-voltage monitor, and configured to change a polarity inversion signal upon receiving the adjustment control signal, so as to adjust the common electrode voltage on the common electrode line;

wherein the common-electrode-voltage monitor comprises:

a common-electrode-voltage detector configured to detect the common electrode voltage on the common electrode line in real time;

a comparator connected with the common-electrode-voltage detector, and configured to determine whether the common electrode voltage is within the first voltage range, and output a fluctuation indication signal in the case that the common electrode voltage is beyond the first voltage range; and a counter connected with the comparator and the polarity inversion controller, and configured to start to count at a start of each frame, read a signal output by the comparator once in each data-source row-latch period of each frame period, increment a count value by 1 in the case that the comparator outputs the fluctuation indictor signal, and output the adjustment control signal to the polarity inversion controller in the case that the count value is incremented by N within one frame period;

wherein the comparator is further configured to compare the common electrode voltage with an upper threshold voltage, and output the fluctuation indication signal in the case that the common electrode voltage is greater than the upper threshold voltage; or compare the common electrode voltage with a lower threshold voltage, and output the fluctuation indication signal in the case that the common electrode voltage is less than the lower threshold voltage;

wherein the upper threshold voltage is greater than the lower threshold voltage;

wherein the comparator comprises a dual-threshold voltage comparator, an input terminal of which is connected with an output terminal of the common-electrode-voltage detector and an output terminal of which is connected with the counter, the dual-threshold voltage comparator being configured to output the fluctuation indication signal in the case that the common electrode voltage is greater than the upper threshold voltage or the common electrode voltage is less than the lower threshold voltage;

the polarity inversion controller is arranged in a timing controller and comprises a control terminal and a polarity inversion signal output terminal;

the counter comprises a trigger terminal, a clock signal input terminal, a reset terminal and an enable signal output terminal;

the trigger terminal of the counter is connected with the output terminal of the dual-threshold voltage comparator;

the reset terminal of the counter is connected with an initial signal output terminal of the timing controller;

the clock signal input terminal of the counter is connected with a data-source row-latch signal output terminal of the timing controller;

the enable signal output terminal of the counter is connected with the control terminal of the polarity inversion controller;

the counter is configured to restart to count from 0 in the case that an initial signal received by the reset terminal of the counter has a high level, wherein the count value of the counter is incremented by 1 in the case that the data-source row-latch signal received by the clock signal input terminal of the counter is latched at a falling edge and the signal that is output by the output terminal of the dual-threshold voltage comparator and read by the trigger terminal of the counter is the fluctuation indication signal;

the enable signal output terminal of the counter is configured to output the adjustment control signal to the control terminal of the polarity inversion controller in the case that the count value of the counter reaches N; and the polarity inversion controller is configured to change the polarity inversion signal upon receiving the adjustment control signal by the control terminal of the polarity inversion controller, and output a changed polarity inversion signal through the polarity inversion signal output terminal.

2. The device according to claim 1, wherein the polarity inversion controller is further configured to change the polarity inversion signal in a current frame or in a next adjacent frame upon receiving the adjustment control signal.

3. The device according to claim 1, wherein the counter is configured to reset the count value to zero at the beginning of each frame.

4. A method for use by the device for adjusting the common electrode voltage according to claim 1, the method comprising:

a monitoring step of detecting the common electrode voltage on the common electrode line in real time on the display panel and judging whether the common electrode voltage is within the first voltage range;

an adjustment-control-signal outputting step of outputting the adjustment control signal in the case that the common electrode voltage is beyond the first voltage range in each of N data-source row-latch periods within one frame period, wherein N is a positive integer; and a polarity inversion controlling step of changing the polarity inversion signal under the control of the adjustment control signal so as to adjust the common electrode voltage on the common electrode line.

5. The method according to claim 4, wherein the polarity inversion controlling step further comprises:

changing the polarity inversion signal in a current frame or a next adjacent frame, and returning to the monitoring step at the beginning of the next adjacent frame.

6. The method according to claim 4, wherein the adjustment-control-signal outputting step further comprises:

outputting a fluctuation indication signal in the case that the common electrode voltage is beyond the first voltage range;

starting to count at the beginning of each frame; and reading a signal output by the comparator once in each data-source row-latch period of each frame period, incrementing a count value by 1 in case of outputting the fluctuation indictor signal, and outputting the adjustment control signal in the case that the count value is incremented by N within one frame period.

7. The method according to claim 6, wherein the step of outputting a fluctuation indication signal in the case that the common electrode voltage is beyond the first voltage range comprises:

outputting the fluctuation indication signal in the case that the common electrode voltage is greater than an upper threshold voltage; or outputting the fluctuation indication signal in the case that the common electrode voltage is less than a lower threshold voltage.

8. The method according to claim 6, wherein the count value is reset to zero at the beginning of each frame.

9. A driving circuit of a display panel, comprising the device for adjusting the common electrode voltage according to claim 1.

10. The driving circuit according to claim 9, further comprising a timing controller, wherein the common-electrode-voltage monitor comprises a common-electrode-voltage detector, a comparator and a counter;

the polarity inversion controller is arranged in the timing controller and comprises a control terminal and a polarity inversion signal output terminal;

the counter is connected with an initial signal output terminal of the timing controller and a data-source row-latch signal output terminal of the timing controller; and an adjustment-control-signal output terminal of the counter is connected with the control terminal.

11. A display device, comprising the driving circuit according to claim 9.

* * * * *